US006564521B1

(12) United States Patent
Brown et al.

(10) Patent No.: US 6,564,521 B1
(45) Date of Patent: May 20, 2003

(54) STRUCTURAL SANDWICH PANELS AND METHOD OF MANUFACTURE OF STRUCTURAL SANDWICH PANELS

(76) Inventors: Paul A. Brown, 107 Pecan La., Sallsbury, NC (US) 28147; Andrew Bennett Hansen, 214 River Rd., Advance, NC (US) 27006

( * ) Notice: Subject to any disclaimer, the term of this patent is extended or adjusted under 35 U.S.C. 154(b) by 0 days.

(21) Appl. No.: 09/569,421

(22) Filed: May 12, 2000

(51) Int. Cl.[7] ..... E04C 1/10

(52) U.S. Cl. ..... 52/309.11; 52/309.9; 52/783.1; 52/405.4

(58) Field of Search ..... 52/783.1, 783.19, 52/309.7, 309.9, 588.1, 592.1, 309.11

(56) References Cited

U.S. PATENT DOCUMENTS

| | | | | | |
|---|---|---|---|---|---|
| 2,663,661 | A | * | 12/1953 | Gramelspacher | 154/118 |
| 4,122,641 | A | * | 10/1978 | Bard et al. | 52/403 |
| 4,196,554 | A | * | 4/1980 | Anderson et al. | 52/394 |
| 4,201,020 | A | * | 5/1980 | Saunders | 52/580 |
| 4,572,857 | A | * | 2/1986 | Bekaert | 52/309.11 X |
| 5,927,032 | A | * | 7/1999 | Record | 52/309.11 |

OTHER PUBLICATIONS

Cirrus Building Products, Inc., "extrusion and Edge Detail Wall Panel Edge", one drwaing sheet dated Aug. 1995.*
Cirrus Building Products, Inc., "Typical 90d Corner Panel Non–Wood Siding", one drawing sheet dated Jun. 1995.*
Cirrus Building Products, Inc., "Typical 135d Corner Panel Non–Wood Siding", one drawing sheet dated Jun. 1995.*

* cited by examiner

*Primary Examiner*—Beth A. Stephan
*Assistant Examiner*—Laura A. Callo
(74) *Attorney, Agent, or Firm*—Adams, Schwartz & Evans, P.A.

(57) ABSTRACT

Rigid structural members, profiles, joints, and forms added to structural sandwich panels to provide higher strength, integral joining joint, and single facing sheet manufacturing. Facing sheets (20) and (22), rigid structural members (24) and (26), latch side and pin side cam-locks (34) and (32), fabricated wire truss assembly (48), and rigid structural headers (28) and (30) and an integrated top plate (29) are positioned into containment form assembly (58) in the proper position. Facing sheets (20) and (22) are placed in position in the containment form assembly (58) forming a structural sandwich panel assembly. A foam resin core material (40) is injected into the structural sandwich panel assembly and allowed to cure. The resultant structural sandwich panel includes rigid structural members (24) and (26) and elongated recesses (36) and (38) which also form a joint for joining abutting structural sandwich panels together and cam-locks (32) and (34) used to secure adjoining panels together. Comer and angle panels have a comer rigid structural assembly (44).

9 Claims, 6 Drawing Sheets

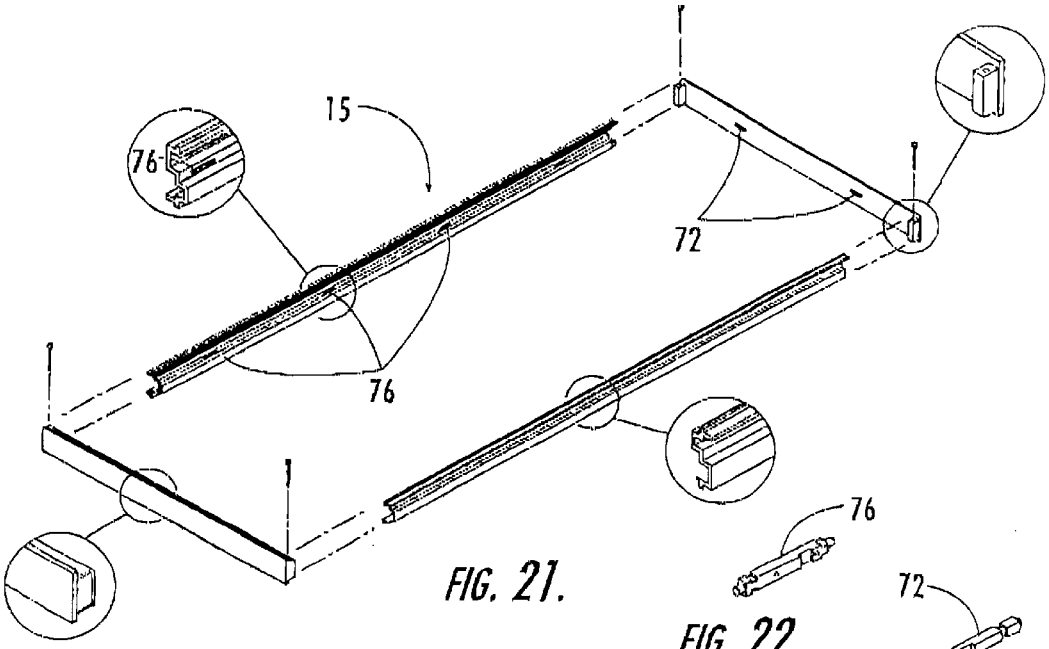
FIG. 21.
FIG. 22.
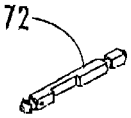
FIG. 23.
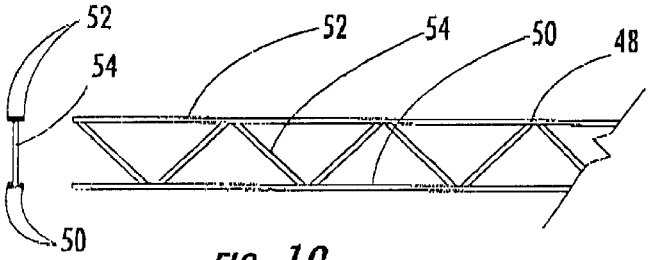
FIG. 19.
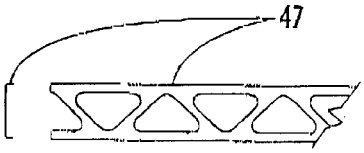
FIG. 20.
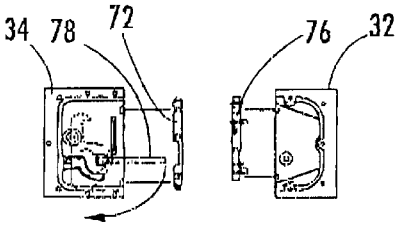
FIG. 16.
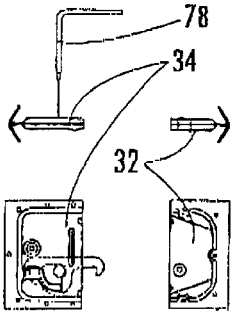
FIG. 17.
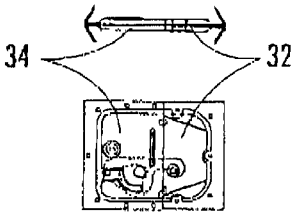
FIG. 18.

STRUCTURAL SANDWICH PANELS AND METHOD OF MANUFACTURE OF STRUCTURAL SANDWICH PANELS

TECHNICAL FIELD AND BACKGROUND OF THE INVENTION

This invention relates to structural sandwich panels, specifically features and structural members integrated into structural sandwich panels used for structure, support, alignment, and joining. In recent years, with the application of new technology and materials, many products have been introduced to compete with conventional stick building methods in residential and light commercial building construction. New products aspire to add new materials, features not before available, to be more efficient in use, and to be more cost effective than conventional methods. Fluctuations in availability and supply, quality standards, and stable cost of dimensional lumber used for framing material and availability of skilled labor are major factors leading to the introduction of alternative building materials. Of specific interest is the development of new methods and materials for use in building panel components; more specifically structural sandwich panels (SSP) and structural insulated panels (SIP). Recently, structural insulated panels have become a recognized method of construction in residential and light commercial buildings.

A structural sandwich panel is an assembly consisting of a lightweight core adhered between two relatively thin, strong facing sheets. The facing sheets typically are metal, plywood, oriented strand board (OSB) or other lightweight material. The core typically are expanded polystyrene foam, rigid urethane foam, injected urethane foam, paper honeycomb or other semi-rigid types.

Performance of structural sandwich panels are dependent on the assembly acting as a complete system. Axial forces in a structural sandwich panel are carried by compression in the sheets, stabilized by the core material against buckling. Bending moments are resisted by an internal couple composed of forces in the facing sheets. Shearing forces are resisted by the core.

The manufacture of structural sandwich panels using expanded polystyrene foam (EPS), rigid urethane or paper honeycomb core type materials differ from injected urethane foam core method.

Expanded polystyrene, rigid urethane, and paper honeycomb type panels are manufactured by utilizing a precut rigid core material which is placed between a first and second facing sheet and joined with adhesive to the contacting side of the facing sheets. Pressure is applied to the surface of the assembly to obtain an acceptable adhesive bond between the rigid core and first and second facing sheets.

Injected cured foamed urethane core panels are manufactured utilizing containment forms along all outside surfaces of the panel assembly. The containment form holds the first and second facing sheets in position and contain the cured foamed urethane core as it is inserted between the facing sheets. Two part liquid thermosetting resin foam, usually urethane, is mixed and injected into the void between the first and second facing sheets where it expands and cures into a rigid core. The thermosetting resin foam chemically reacts to produce heat and pressure which expands and cures to fill the cavity with a rigid urethane foam core. The edges are formed against the containment forms. The profile of a containment form is transferred to the rigid cured foamed core. Manufacturing by injecting a rigid cured foam urethane core requires a substantial manufacturing containment device, commonly called a fixture. The fixture contains the first and second facing sheets and all edges by exerting pressure on the containment form and the structural sandwich panel assembly sufficient to resist the pressures developed by the expanding urethane foam core during the chemical reaction process.

Structural sandwich panels are typically joined by a groove cut into the core material and fitted with a spline at the joining edges. The spline is secured to the first and second facing sheets with nails or screws. In some cases, when employing urethane core, adjoining panels are joined by means of a molded joint formed by the shape of the containment form. Currently, both methods of manufacture require additional exterior and interior facing material to reach finished condition when used as building panels.

The current methods of manufacturing structural sandwich panels are unsatisfactory as the invention utilizes finished exterior and interior facings to develop the strength for use in residential and commercial buildings and reduces the amount of labor the builder employs to install the necessary exterior and interior finish materials. Additionally, the invention significantly reduces the assembly time necessary to complete a finished wall, floor or roof system and uses less material to achieve superior results.

Another problem with current techniques employed in manufacturing structural sandwich panel products is the incorporation of headers and plates to distribute loads imposed by concentrated weights over windows, doors, and the like. In addition, when a dense material is allowed to bridge between the first and second facing sheets, thermo-wicking is evident through the panel. Thermo-wicking reduces insulation qualities of the panel by allowing heat transfer at the contact points. The invention places rigid structural members and rigid structural headers in a position to allow a thermo break between the first and second facing sheets.

The present invention relates to a method and system of manufacture, assembly, and construction of structural sandwich panels enabling the more efficient use of standard materials commonly used in the construction industry and incorporating additional features currently not found in the structural sandwich panel products. The present invention also relates to the increased energy savings by the use of high insulation values of cured foam urethane core. The present invention also related to the use of cured foam urethane core to bond to the structural members and embedded them into the structural sandwich panel. Integrating rigid structural members into the manufactured structural sandwich panel will increase structural strength of the panel assembly. In addition, integrating rigid structural members in the structural sandwich panel will supplement the requirement of individual panel facings to carry structural loads imposed on the panel assembly. The resultant savings are realized from eliminating application of secondary finish facings sheets to either the interior or exterior surfaces of structural sandwich panels. The invention relates to the incorporation of rigid structural members contained within the panel assembly to allow the use of finished panel material in the manufacture of the structural sandwich panel assembly.

The invention also relates to the manufacturer of 90 degree comer and variable angle structural sandwich panels as a single structural unit. The comer and angle structural sandwich panel provides positive control at angle transitions and increase strength of critical components that are inherently weak and join at high stress points. The invention also relates to the use of rigid structural member and elongated recess to form and function as a joint for abutting structural sandwich panel. The joining method permit adjoining structural sandwich panels to align and lock firmly in place and provide a joining method that will be structurally sound and protective of the panel during shipment. The invention relates to the use of a containment form at edges of the panel to form the elongated recess for mating the rigid structural member and other edge profiles as required. The invention also relates to incorporation of structural fabricated truss member into the structural sandwich panel cavity to increase the load capability of the panel assembly. The utilization of a structural fabricated truss member would increase the strength of the structural sandwich panel assembly and decrease the dependence of external beams and trusses the support of roof and floor structural sandwich panels. Roof and floor structural sandwich panels having rigid structural members at the edges and structural fabricated truss members integral to the interior of the assembly will allow the use of finished facing materials eliminating the application of a secondary facing to finish the panel assembly.

SUMMARY OF THE INVENTION

It is an object of the invention to provide a unique structural sandwich panel for use handling structures and the like, which panel provides high strength, positive joining, high insulation values, greater utilization of material, reduced labor, and lower application cost.

It is another object of the invention to provide structural bearing points at the joining edge of abutting panels by the inclusion of foamed-in-place rigid structural member which provide support for loads imposed by mating components and other conditions. The rigid structural member at the edge of the structural sandwich panel provides a male spine for joining the panel to the abutting panel. An elongated recess on the edge of the structural sandwich panel is formed by transferring the profile of the containment form to the cured foam resin core during manufacture. The elongated recess accepts the rigid structural member of the abutting structural sandwich panel to form a positive joint. Positioned placement of the rigid structural member provide for a thermo break between the first and second facing sheets and eliminate thermo-wicking at the joints. All the above features are heretofore unavailable.

It is another object of the invention to provide to embody a single assembly ninety degree (90 degree) comer structural sandwich panel containing a comer rigid structural member assembly. The comer rigid structural member is a load bearing assembly adhered by the cured foam resin core at the angle point, features heretofore unavailable.

It is another object of the invention to provide a single assembly angled structural sandwich panel containing a comer rigid structural member assembly. The comer rigid structural member is a load bearing assembly adhered by the cured foam resin core at the angle point, features heretofore unavailable.

It is another object of the invention to provide to incorporate a rigid structural header in the cured foam resin core of the structural sandwich panel to distribute loads, provide structural strength, and to increase the construction efficiency in a manner and to a degree not heretofore available.

According to yet another preferred embodiment of the invention to incorporate a fabricated wire truss assembly in the cured foam resin core of the structural sandwich panel to provide additional strength and structural load carrying ability, features heretofore unavailable.

Structural sandwich panels are produced in controlled manufacturing environment to maintain a uniform product and allow extensive modification. The incorporation of rigid structural members and assemblies in the structural sandwich panel will allow the use of facing sheet material not currently utilized. The incorporation of rigid structural members positioned to mate with elongated recesses will form a thermo break joint with alignment and structural properties. The structural sandwich panel resulting from the invention will result in higher strength, better material utilization, high insulation values, decreased cost, increased flexibility, and decreased construction time. The attributes of panel construction allow the construction of a closed in, weather tight shell buildings, substantially finished on the first and second facings, in days instead of weeks.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 16 shows pin side and latch side cam-lock assemblies, pin side and latch side cam-lock retainers and cam-lick activation wrench for a structural panel in accordance with the invention;

FIG. 17 shows plan and top views of pin side and latch side cam-lock assemblies and cam-lock activation wrench, showing cooperative alignment;

FIG. 18 shows pin side and latch side cam-lick assemblies in locked position as in joining abutting structural panels as in connection with their use in building construction;

FIG. 19 shows a typical fabricated wire truss assembly used in the interior of roof, floor, and like panels.

FIG. 20 shows a typical formed rigid metal truss assembly used in the interior of roof, floor, and like panels;

FIG. 21 is an isometric view of a typical wall panel containment form assembly employing a containment form member as shown in FIG. 13 in first and second sides for cooperating alignment and locating rigid structural members, a containment form member as shown in FIG. 14 for flush application of cured foam resin core and a containment form member as shown in FIG. 16 for cooperating alignment of a sole plate;

FIG. 22 is an isometric view of a pin side cam-lock retainer; and

FIG. 23 is an isometric view of a latch side cam-lock retainer.

DESCRIPTION OF THE PREFERRED EMBODIMENT AND BEST MODE

Figure 2:
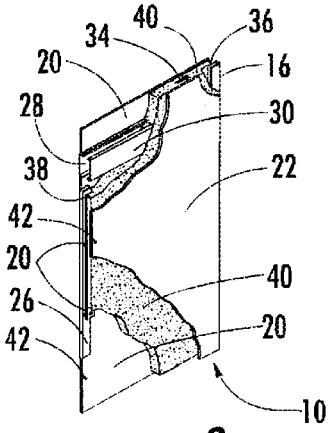
FIG. 2 is an isometric cut-away view of a straight wall panel with first and second rigid structural members, first and second rigid structural headers, cured foam resin core with first and second elongated recesses, and first and second facing sheets.
Figure 3A:
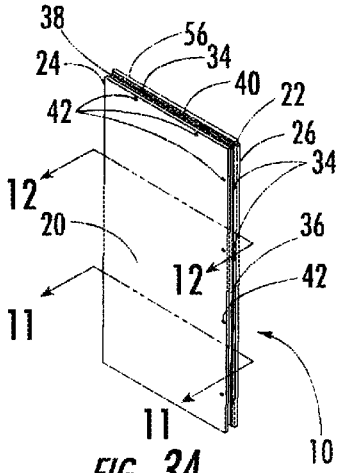
FIGS. 3A and 3B are isometric and fragmentary views of a straight wall panel with first, second and third rigid structural members.
Figure 3B:
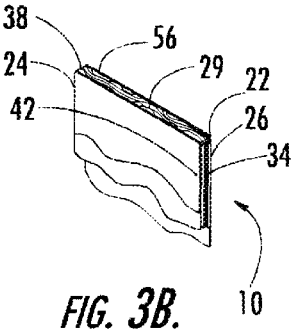

Referring now specifically to the drawings, a preferred embodiment of the present invention as it relates to a typical structural sandwich panel used in wall configurations are illustrated in FIGS. 1, 2, 3 and 4 at broad reference numeral 10. Panel 10 includes a first facing sheet 20 of a continuous uniform cross section material with opposing first and second side edges and opposing top and bottom edges and a second facing sheet 22 of a continuous uniform cross section material having configuration corresponding substantially to that of the first facing sheet 20. The first and second facing sheets 20, 22 are typically utilized in the construction of residential and commercial structures such as APA rated plywood siding, APA rated oriented strand board (OSB), Fiber Cement panel, 25 gauge Galvinized steel sheet, or the like. A first rigid structural member 24 and a second rigid structural member 26 are placed on opposing first and second edges of the structural sandwich panel 10. An evenly spaced number of pin side cam-lock 32 assemblies are placed along the center line of the first edge of the panel 10 and corresponding number of latch side cam-lock 34 assemblies are placed along the center line of the second edge of the panel 10 corresponding to the spacing of the pin side cam-lock 32 assemblies along the first edge. A like configuration of cam-lock assemblies may be placed on the top edge and bottom edge of the structural sandwich panel 10 to align adjoining panels. A first rigid structural header 28 is placed adjacent to first facing sheet 20 at a height determined by opening height and interfacing with first rigid structural member 24 and second rigid structural header 30 is placed adjacent to second facing sheet 22 directly opposite first rigid structural header 28. A void between the inside surface of the first facing sheet 20 and the inside surface of the second facing sheet 22 is filled with a conventional cured foam resin core 40. The void between the first facing sheet 20 and the second facing sheet 22 typically conforms to the dimensions of commercial framing material such as 2×4 and 2×6 lumber and metal framing material. A 2×10 top plate 29 is positioned and embedded between the first facing sheet 20 and the second facing sheet 22.

The injected material forming the cured foam resin core 40 fills the void and adheres and bonds to the first facing sheet 20 and second facing sheet 22; the first rigid structural member 24 and the second rigid structural member 26; the first rigid structural header 28 and the second rigid structural member 30; the pin side cam-lock assemblies 32 and the pin side cam-lock assemblies 34.

Figure 14:
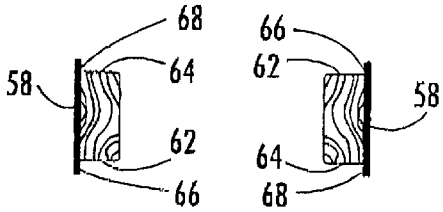
FIG. 14 is a cross section of the containment form assembly for flush application of cured foam urethane.

The cured foam resin core 40 is contained during manufacture by the containment form assembly 58 as shown in FIG. 14.

Figure 15:
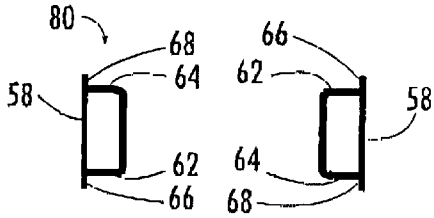
FIG. 15 is a cross section of the containment form assembly for cooperating alignment of sole and top plates.

A first elongated recess 36 is formed along the first edge of the structural sandwich panel and a second elongated recess 38 is formed along the second edge of the structural sandwich panel by the cured foam resin core 40. A flush, cured foam resin core edge is formed on a edge of the structural panel by utilizing a flat containment profile as shown in FIG. 14, and a recessed edge of the structural panel 10, such as a sole or top plate, by utilizing a recessed profile such as is shown in FIG. 15. The edges on the panels 10 serve as cooperating alignment means with abutting structural panels 10.

FIGS. 5A, 5B, 6A and 6B show a panel 11 for inside and outside right angled corners. In addition to the described elements in FIGS. 1–4, which are identified by like reference numerals, a corner rigid structural assembly 44 is affixed to the two first facing sheets 20 forming the outside angle of the structural sandwich corner panel. The comer rigid structural assembly 44 is formed by affixing a series of spaced corner rigid structural straps 46 to the edges of the corner rigid structural member 45. The inclusion of the corner rigid structural assembly 44 to the right angled and angled comer structural sandwich panel allow for cured foam resin core 40 to adhere to the surface of the corner rigid structural assembly 44 and allow additional loads to be carried by the corner structural panel assembly.

Figure 8:
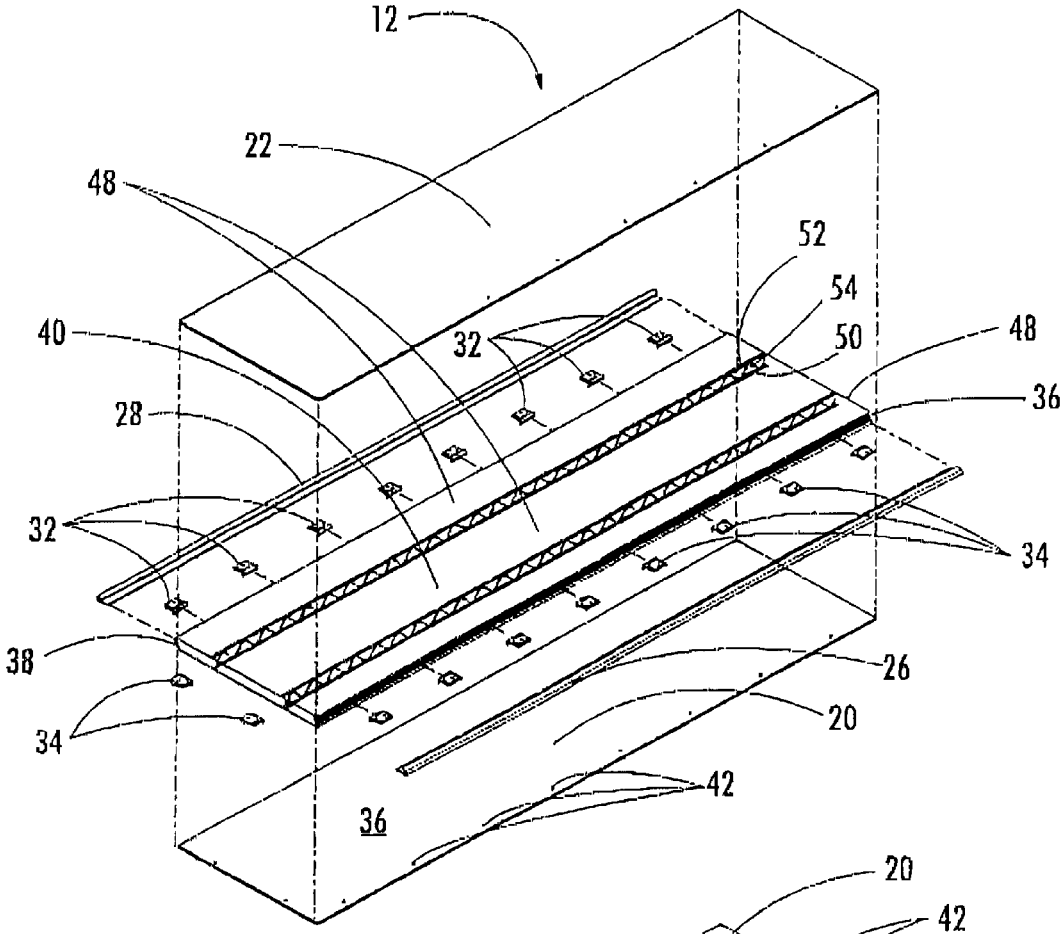
FIG. 8 is an exploded view of a panel used in roof and floor applications showing components of the panel assembly.
Figure 7:
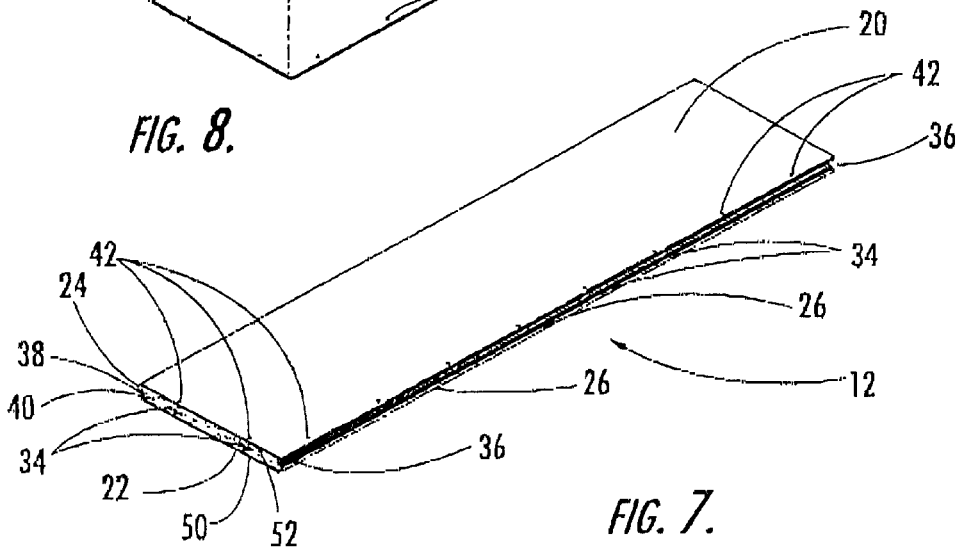
FIG. 7 is an isometric view of a panel used in roof and floor applications showing first and second rigid members and fabricated wire truss assemblies.

FIGS. 7 and 8 show a further embodiment 12 of a roof structural sandwich panel and a floor structural sandwich panel. In addition to the described elements in FIGS. 1–4, a fabricated wire truss assembly 48 or a formed rigid metal truss (not shown) is oriented at right angles to the inside surface of the first facing sheet 20 and the inside surface of the second facing sheet 22. The fabricated wire truss assembly 48 is spaced evenly from the first edge of the structural sandwich panel and the second edge of the structural sandwich panel. The fabricate wire truss assembly 48 is manufactured by forming a wire truss web 54 at approximately right angle bends to a thickness of the core of the structural sandwich panel. The wire truss web 54 is placed between tow wire truss bottom cord members 50 and between two wire truss top cord members 52 and secured at the bends forming the fabricated wire truss assembly 48.

Figure 9:
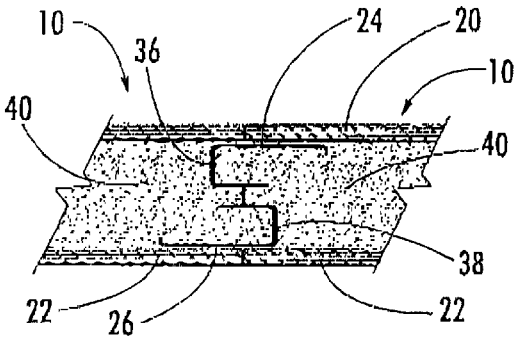
FIG. 9 is a cross section of the joining alignment of a structural panel with an abutting structural panel.
Figure 10:
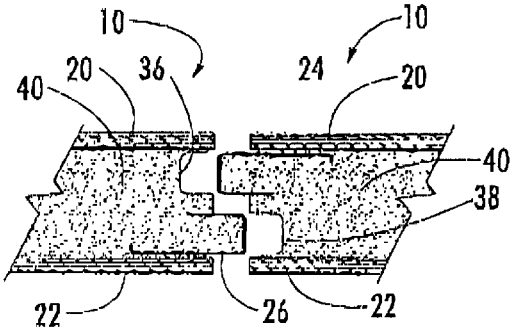
FIG. 10 is a cross-section taken substantially along line 10—10 of FIG. 3, showing the cooperating alignment of one structural panel with an abutting structural panel.

FIG. 9–10 shows cooperating alignment and locating rigid structural members serving to align a structural sandwich panel 10 with abutting structural panels 10 in connection with their use in building construction. The first facing sheet 20, the second facing sheet 22, and the cured foam resin core 40 of abutting structural sandwich panels 10 are aligned and joined by the first rigid structural member 24 being inserted into the matching second elongated recess 38 formed in the cured foam resin core of the adjacent structural sandwich panel 10 and the second structural member 26 being inserted into the matching first elongated recess 36 formed in the cured foam resin core of the adjacent structural sandwich panel 10. The closure of abutting structural sandwich panels 10 embodies a first rigid structural member 24 and a second rigid structural member 26 giving additional structural strength to the structural sandwich panel while providing a positive alignment and providing a positive joint while disallowing thermo-wicking at the closure.

Figure 11:
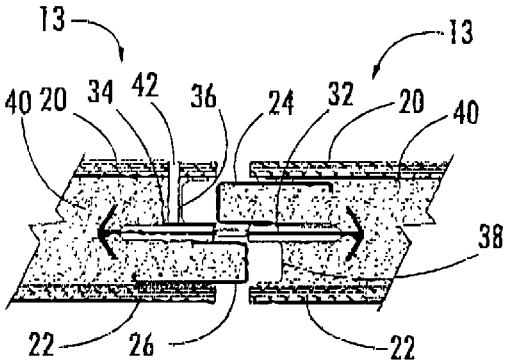
FIG. 11 is a cross section of a wall panel showing first and second rigid structural members, first and second elongated recesses, pin side and latch side cam-log assemblies and first and second facing sheets.

FIG. 11 shows a further embodiment of the sandwich panel 13 which includes a pin side cam-lock assembly 32 in the joint of the structural sandwich panel 13 and a latch side cam-lock assembly 34 in the abutting structural sandwich panel assembly. The interaction of the pin-side cam 20 lock assembly 32 and the latch side cam-lock assembly 34 align abutting structural sandwich panels while drawing abutting structural sandwich panels together and locking said panels securely in place. The latch side cam-lock assembly 32 is activated by inserting cam-lock activation wrench 78 through the positioned access hole to cam-lock 42 located in the first facing sheet 20 and the cured foam resin core 40.

Figure 12:
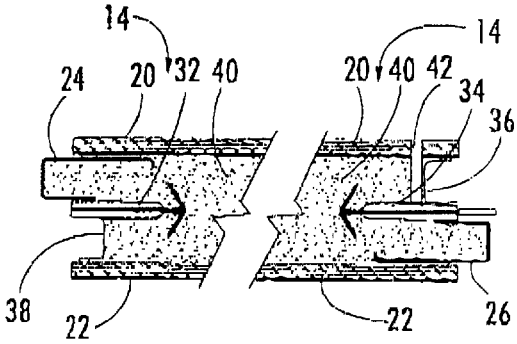
FIG. 12 is a cross section taken substantially along lines 12—12 of FIG. 3, showing the cooperating alignment of one structural panel with an abutting structural panel.

FIG. 12 shows a section through a structural sandwich panel 14 locating the first facing sheet 20, second facing sheet 22, cured foam resin core 40, first rigid structural member 24, second rigid structural member 26, first elongated recess 36, second elongated recess 38, pin side cam-lock assembly 32, latch side cam-lock assembly 34, and cam-lock access hole 42 through first facing sheet 20 and cured foam resin core 40 to activate latch side cam-lock assembly 34.

Figure 13:
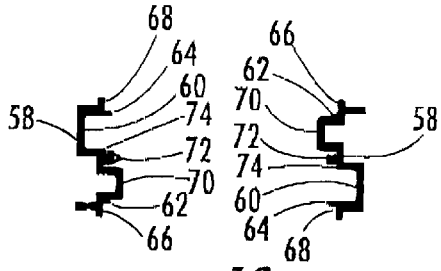
FIG. 13 is a cross section of the containment form assembly for aligning adjacent panels and locating odd structural members.

FIGS. 13–15 show sections of the profiles used in the containment form assembly to manufacture edges of structural sandwich panels. FIG. 13 shows a section view of a containment form profile where the inclusion of rigid structural members 24 or 26 and elongated recess 36 or 38 are to formed. FIG. 13 profile embodies a containment form first facing stop 62 to hold first facing sheet 20 in place and a containment form first facing step 62 to hold first facing sheet 20 and containment form second facing stop 68 to hold second facing sheet 22 in place and a containment form first facing step 64 to hold second facing sheet 22 all of which position the facing sheets and form the void for the cured foam resin core 40. FIG. 13 also embodies a rigid structural member receptacle 60 for locating first rigid structural member 24 and containment form elongated recess form 70 to form the second elongated recess 38. FIG. 13 also embodies a cam-lock mating surface edge 74 to locate the pin side cam-lock retainer 76. Reversing the profile in FIG. 13 embodies the elements above in addition allows the cam-lock mating surface edge 74 to locate the latch side cam 20 lock retainer 72.

Figure 14A:
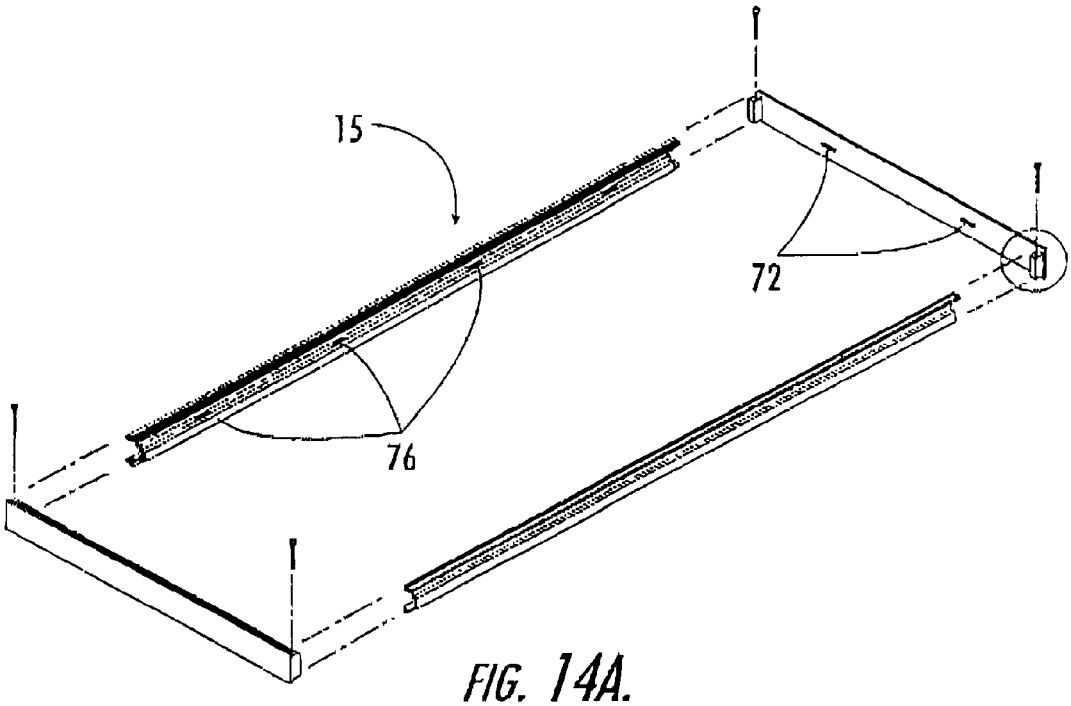
FIG. 14A is a perspective exploded view of the containment form assembly for flush application of cured foam urethane.

FIG. 14A illustrates a containment form, and FIG. 14 shows a section view profile used for a flush edge on a structural sandwich panel 15. FIG. 14 embodies a containment form first facing sheet stop 66 and first facing sheet step 62 for locating and positioning first facing sheet 20 and a containment form second facing sheet stop 68 and containment form second facing sheet step 64 for locating and positioning second facing sheet 22. Additionally, pin side cam-lock retainer 76 or latch side cam-lock retainer 72 can be located on the surface of the profile for inclusion of pin-side cam-lock assembly 32 or latch side cam-lock assembly 34 when required for abutting structural sandwich panels.

Figure 1B:
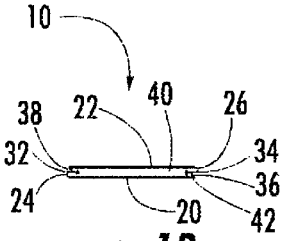
FIGS. 1A, 1B, and 1C illustrates a wall panel in front, top and side elevations according to the present invention.
Figure 1A:
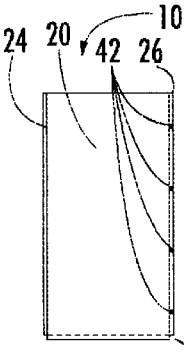
Figure 1C:
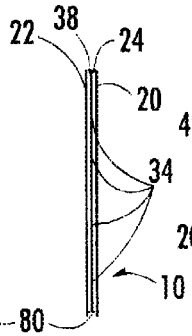
Figure 4:
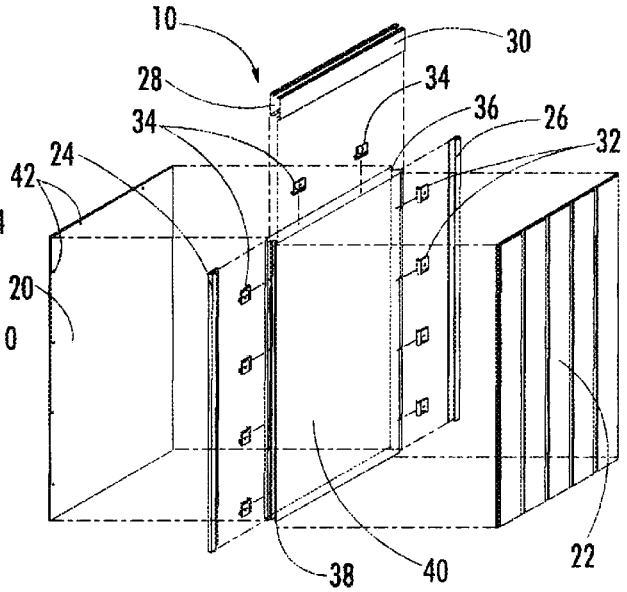
FIG. 4 is an exploded view of a wall panel according to an embodiment of the invention.
Figure 6C:
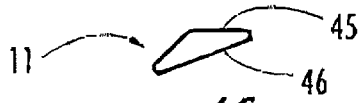
FIG. 6C is a top view of the comer rigid structural member.
Figure 6A:
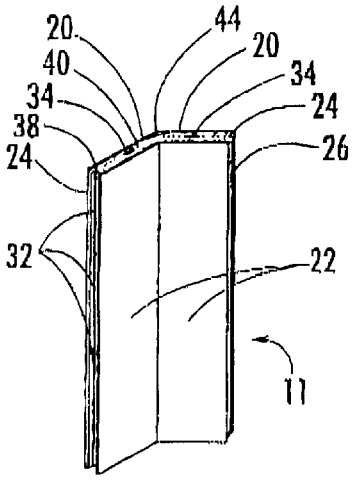
FIG. 6A is an isometric view of a variable angle wall panel at a 135 degree angle, with first and second rigid structural members and variable comer rigid structural member.
Figure 6B:
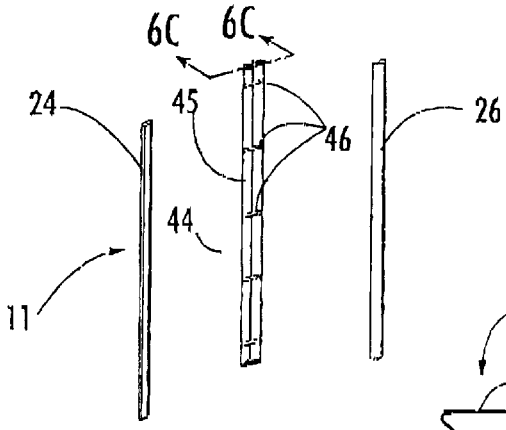
FIG. 6B shows the first and second rigid structural members, variable comer rigid structural member and the isometric orientation of said rigid structural members in FIG. 6A.
Figure 5C:
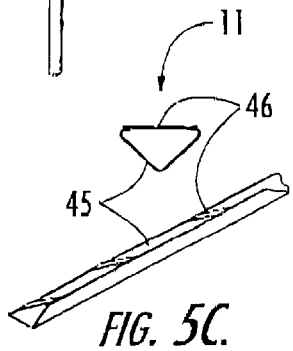
FIG. 5C is a top view of the comer rigid structural member.
Figure 5A:
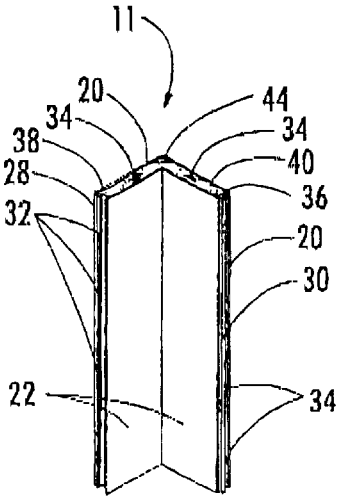
FIG. 5A is an isometric view of a right angle coiner wall panel with first and second rigid structural members and comer rigid structural member.
Figure 5B:
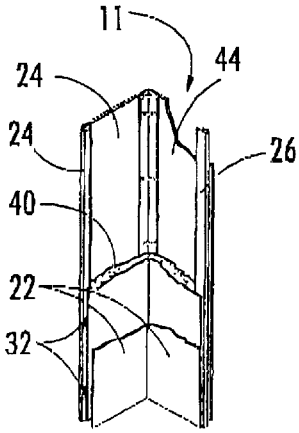
FIG. 5B shows the first and second rigid structural members, comer rigid structural member and the isometric orientation of said rigid structural member in FIG. 5A.
Figure 5B:
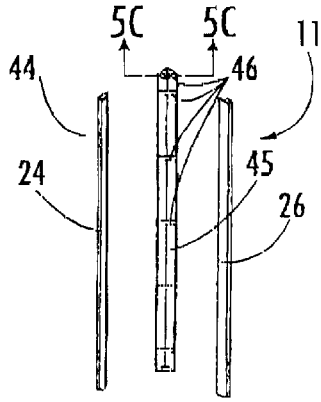

FIG. 1 shows a panel recess 80 and embodies elements described in FIG. 14.

FIGS. 16–18 show latch side cam-lock assemblies 34 and pin side cam-lock assemblies 82 as manufactured by Kason Hardware, a Division of Kason Industries, Inc. of Shenandoah, Ga. FIG. 16 shows a latch side cam-lock assembly 34 and a latch side cam-lock retainer 72. The latch side cam-lock retainer 72 is affixed to the containment form assembly 58 and correctly positions and holds the latch side cam-lock 34 during manufacture. The cam-lock activation wrench 78 is shown in position for activation and is rotated to cause the latch on the latch side cam-lock assembly 34 to rotate and contact and engage the pin in the pin side cam-lock assembly 82 and draw and close cam-lock assemblies together.

FIG. 17 shows plan and top view and embodies elements described in FIG. 16.

FIG. 18 shows plan and top view and embodies elements described in FIG. 16.

FIG. 19 shows plan and end view of fabricate wire truss assembly 48. The fabricated wire truss assembly 48 is manufactured by forming a wire truss web 54 at approximately right angle bends to a thickness of the core of the structural sandwich panel. The wire truss web 54 is placed between two wire truss bottom cord members 50 and between tow wire truss top cord members 52 and secured at the bends forming the fabricated wire truss assembly 48.

FIG. 20 shows plan and end view of formed rigid metal truss 47 and may be substituted for fabricated wire truss assembly 48 as described in FIG. 19. FIG. 21 shows an isometric view of a typical containment form assembly 58 and contains elements described above in FIGS. 13–15.

FIG. 22 and FIG. 23 show isometric view of a typical pin side cam-lock retainer 76 and of a typical latch side cam-lock retainer 72 that are to affixed to a containment form FIG. 21 at spaced intervals. The pin side cam-lock retainer 76 will only accept a pin side cam-lock assembly 34 that is oriented properly. The pin side cam-lock retainer 76 is located on, but not limited to, the first side of the containment form FIG. 21 and the latch side cam-lock retainer 72 is located on, but not limited to, the first side of the containment form FIG. 21 and the latch side cam-lock retainer 72 is located on, but not limited to, the second side of the containment form FIG. 21. The retainers are to position and secure the pin side cam-lock assemblies 34 during manufacturing and to be secured by the cured foam resin core 40. A finished cured structural sandwich panel assembly FIG. 21 after manufacturing. The pin side cam-lock retainers 76 and the latch side cam-lock retainers 72 release from the pin side cam-lock assemblies 32 and the latch side cam-lock assemblies 34 and remain attached to the containment form FIG. 21 to be used.

The invention has variable configurations in length, width, and depth of structural sandwich panels assemblies and the structural members embedded within the cured foam resin core of the assembly. Each of the structural members place within the panel are variable in size and material to enhance the application of panels according to structural requirements and design. The invention embodies a single piece, ninety degree (90 degree) comer structural sandwich panel containing a comer rigid structural member assembly. The comer rigid structural member is a load bearing assembly adhered by the cured foam resin core at the angle point, features heretofore unavailable.

Manufacturing Process

A manufacturing process of the invention utilizes the containment form FIG. 14 which is assembled and locked together to form the desired profile of the first and second edge and top and bottom edge FIGS. 13–15 and conforming to the first facing sheet 20 and second facing sheet 22. The number of latch side cam-lock retainers 72 and pin side cam-lock retainers 76 are permanently secured to the inside face of the containment form assembly FIG. 14, at spaced intervals, located on the cam-lock mating surface edge 74. The inside surface of the containment form FIG. 14 is coated with a thin coat of release agent to prevent the cured foam resin core from adhering to the containment form FIG. 14 surface. Pin side cam-lock assemblies 32 are snapped in position on the pin side cam-lock retainers 76 located on the containment form FIG. 14 on the cam-lock mating surface edge 74. Latch side cam-lock assemblies 34 are snapped into position on the latch side cam-lock retainers 72 located on the containment form FIG. 14 on the cam-lock mating surface edge 74. The first facing sheet 20 edges are positioned against the containment form first facing stop 66 and upon the containment form first facing step 62 and secured. The first rigid structural member 24 is positioned in the containment form assembly FIG. 14 and inserted into the rigid structural member receptacle 60 and secured. The second rigid structural member 26 is positioned in the containment form assembly FIG. 14 and inserted into the rigid structural member 26 is positioned in the containment form assembly FIG. 14 and inserted into the rigid structural member receptacle 60 on the opposing containment form assembly FIG. 14 and secured. Additionally, if required, the third rigid structural member 56 is positioned on the top of the containment form assembly FIG. 14 in the rigid structural member receptacle 60. Additionally, if required, the first rigid structural header 28 and the second rigid structural header 30 are positioned into the proper position and secured. The second facing sheet 22 edges are positioned in the containment form assembly FIG. 14 against the containment form second facing stop 68 and upon the containment form second facing step 64 and secured. The structural sandwich panel assembly contained by the containment form assembly FIG. 14 is placed in a manufacturing fixture (jack) that exerts pressure on the first facing sheet 20 and the second facing sheet 22, and the edges of the containment form FIG. 14. The manufacturing fixture is sufficient hold the panel assembly in position and to resist the pressure and heat developed by the expanding cured foam resin core 40 material. A mixture to form the cure foam resin core 40, typically a two part liquid that is mixed and injected by a foam injection machine, is introduced into a structural sandwich panel assembly cavity through a hole or holes in the containment form FIG. 14. The chemical reaction of the two part cured foam resin core 40 material produces expansion of the combined agent which expands and fills a cavity in the structural sandwich panel assembly. The expanding cured foam resin core material 40 fills the voids in the structural sandwich panel and bonds to the first facing sheet 20 and the second facing sheet 22, fills, surrounds and bonds to the first rigid structural member 24, the second rigid structural member 26, surrounds and bonds to the pin side cam-lock assembly remains in a manufacturing fixture after the introduction of the cured foam resin core material 40 until the foamed core has stabilized and cure sufficiently.

Manufacture of Roof and Floor Structural Sandwich Panel Assembly

The fabricated wire truss bottom cord 50 and the second facing sheet 22 are adjacent to the wire truss top cord 52 along the length of the structural sandwich panel assembly. The manufacture of corner structural sandwich panels of FIG. 5A and FIG. 5B and angle structural sandwich panels of FIG. 6A and FIG. 6B substantially are described above with the additional placement of the corner rigid structural assembly 44 being placed into the interior core of the structural sandwich panel assembly. The comer rigid structural assembly 44 is positioned to the outside comer surface of the two first facing sheets 20 being adjacent angle formed in the comer rigid structural member 45 along the length of the comer structural sandwich panel assembly. A manufacturing fixture designed to accept the comer structural sandwich panel assembly is utilized. The manufacturing fixture is sufficient hold the comer structural sandwich panel assembly in position and to resist the pressure and heat developed by the expanding cured foam resin core 40 material.

From the description above, the advantages of rigid structural members being integrated into a structural sandwich panel become evident. Placing rigid structural members in edges of the panels provides:

(a) structural support for the structural sandwich panels in compression, sheer, bending, and tension;

(b) a means for joining abutting structural sandwich panels by inserting the first rigid structural member into the elongated recess of the adjacent structural sandwich panel;

(c) separation of the first rigid structural member from the second rigid structural member forming a thermo break so as not to have a continuous membrane between the first facing sheet and the second facing sheet which would allow thermo-wicking;

(d) a solid rigid structural member for protection of the protruding joining member which reduce or eliminate damage during handling and shipping;

(e) the use of finished first facing sheet and second facing sheet surfaces on the interior and exterior of the building panel does not require additional facing to be applied to finish; and (f) a simplified method of joining and securing adjoining panels by the use of latch side cam-lock assemblies and pin side cam-lock assemblies.

Placing rigid structural headers into the cured foam resin core of the structural sandwich panel provides support over openings and serves to case the rough opening as well as providing additional strength and transfer loads to the edge of the panels where structural members have been placed. A form is provided in a top opening for rough in of door and window unit and the like, as well as a ridge structural header member for openings for beam pockets, joist, headers and the like.

Placing structural fabricated wire truss assemblies into the cured foam resin core of the structural sandwich panel assembly will provides additional bending strength for roof and floor structural sandwich panels, minimizes deflection between unsupported spans and allow for greater spans and loads to be carried and allows for the use of alternative facing sheet material which allows the substitution of finished interior and exterior facings materials. The use of elongated recesses and cam-lock assemblies provides a rapid and convenient method of building by locating abutting structural sandwich panel joints and method of securing and alignment, a joint that is strong and concealed from view, a method of building that requires little expertise and results in a reduction in labor costs, and thermo-breaks and retention of thermo properties of the structural sandwich panel.

The use of a structural sandwich panel assembly provides a high energy efficient building system, abetter utilization of material and substantial reduction of waste material, reduced labor and expertise, a time-saving building system and a reduction in material duplication.

Key to Reference Numerals

| | |
|---|---|
| 20 first facing sheet | 22 second facing sheet |
| 24 first rigid structural member | 26 second rigid structural member |
| 28 first rigid structural header | 29 wooden 2x plate |
| 30 second rigid structural header | 32 pin side cam-lock assembly |
| 34 latch side cam-lock assembly | 36 first elongated recess |
| 38 second elongated recess | 40 cured foam resin core |
| 42 access hold to cam-lock | 44 corner rigid structural assembly |
| 45 corner rigid structural member | 46 corner rigid structural strap |
| 47 formed rigid metal truss | 48 fabricated wire truss assembly |
| 50 wire truss bottom cord | 52 wire truss top cord |
| 54 wire truss web | 56 third rigid structural member |
| 58 containment form assembly | 60 rigid structural member receptacle |
| 62 containment form first facing sheet step | 64 containment form second facing sheet step |
| 66 containment form first facing sheet stop | 68 containment form second facing sheet stop form |
| 70 containment form elongated recess | 72 latch side cam-lock retainer |
| 74 cam-lock mating surface edge | 76 pin side cam-lock retainer |
| 78 cam-lock activation wrench | 80 sole plate panel recess |
| 82 top plate panel recess | |

We claim:

1. A structural building panel, comprising:

(a) a first facing sheet having opposing first and second side edges and opposing top and bottom edges;

(b) a second facing sheet having a size and configuration corresponding to that of the first facing sheet, said second facing sheet having opposing first and second side edges and opposing top and bottom edges and being disposed in opposing, spaced-apart relationship to said first facing sheet;

(c) a core of cured foam resin disposed between and adhered to said first and second facing sheets to define an insulation barrier between the first and second facing sheets;

(d) a first elongate recess formed in and defined by exposed surfaces of the core of cured foam resin adjacent to and co-extensive with the first side edge of said first facing sheet for receiving a spline of a first abutting building panel;

(e) a second elongate recess formed in and defined by exposed surfaces of the core of cured foam resin adjacent to and co-extensive with the second side edge of said second facing sheet for receiving a spline of a second abutting building panel;

(f) a first rigid structural spline member positioned adjacent to and co-extensive with the first side edge of said second facing sheet for being matingly fitted into the complementary recess defined by exposed surfaces of the core of cured foam resin of the first abutting building panel, said first rigid structural spline member providing a form into which foam resin is molded to provide re-enforced support to the foam underlying the spline member;

(g) a second rigid structural spline member positioned adjacent to and co-extensive with the second side edge of said first facing sheet for being matingly fitted into the complementary recess defined by exposed surfaces of a core of cured foam resin of the second abutting building panel, said first rigid structural spline member providing a form into which foam resin is molded to provide re-enforced support to the foam underlying the spline member;

(h) said first structural spline member and second structural spline member each being spaced-apart from at least one of the first and second facing sheets for reducing thermal transfer between the first and second spacing sheets.

2. A structural building panel according to claim 1, and including cooperating alignment members associated with the core of cured foam resin and disposed adjacent to said first and second spline structural members for aligning said structural panel with the first and second abutting structural panels in a building construction and locking said structural panel together with abutting structural panels to form a structural wall system.

3. A structural building panel in accordance with claim 2, wherein said cooperating alignment members include a plurality of cam-locks for connecting said structural panel with said first and second abutting structural panels.

4. A structural building panel in accordance with claim 2, wherein said first and second structural spline members are formed from metallic load-bearing material.

5. A structural building panel in accordance with claim 4, wherein the core of cured foamed resin includes a load-bearing header co-extensive with the opposing top edges of the first and second facing sheets with the header being supported in part by said first and second structural spline members.

6. A structural building panel in accordance with claim 5, wherein said core of cured foamed resin includes therein a plurality of spaced reinforcement truss members to increase the strength of the structural panel.

7. A structural building panel according to claim 2, wherein said structural panel is comprised of first and second integrally-formed structural member segments positioned at a predetermined angle relative to each other less than 180 degrees for forming a corner structure.

8. A structural building panel according to claim 2, wherein said structural panel is comprised of first and second integrally-formed structural member segments positioned at a right angle to each other for forming a right angle corner structure.

9. A structural building panel according to claim 2, wherein said structural panel is comprised of first and second integrally-formed structural member segments positioned at an angle of 135 degrees to each other for forming a 135 degree corner structure.

* * * * *